United States Patent [19]

Becker

[11] 4,034,978

[45] July 12, 1977

[54] TABLE TENNIS TABLE GOAL CONVERSION KIT

[76] Inventor: Clifford W. Becker, 10472 Gregory Court, St. Louis, Mo. 63128

[21] Appl. No.: 622,250

[22] Filed: Oct. 14, 1975

[51] Int. Cl.[2] ..... A63B 61/00

[52] U.S. Cl. ..... 273/30

[58] Field of Search ..... 273/30, 95 G, 96 R, 273/105 R, 102 R, 127 R, 127 B, 85 R, 85 A, 85 B, 85 C, 85 D, 85 E, 85 F, 4 R, 5 R, 12, 14

[56] References Cited

U.S. PATENT DOCUMENTS

| | | | |
|---|---|---|---|
| 1,064,914 | 6/1913 | Jones | 273/85 R |
| 2,051,476 | 8/1936 | Grant | 273/30 |
| 2,215,687 | 9/1940 | Carter | 273/85 D |
| 3,001,791 | 9/1961 | Atwood | 273/30 |
| 3,580,578 | 5/1971 | McCarthy | 273/105 R |

*Primary Examiner*—Richard C. Pinkham
*Assistant Examiner*—T. Brown
*Attorney, Agent, or Firm*—Cohn, Powell & Hind

[57] ABSTRACT

This table tennis game utilizes a conventional table, paddles, center net and ball together with end goals which are supplied in the form of a conversion kit. The conversion kit includes a pair of end goals detachably mounted to the table, each goal being formed from a frame having upper, lower and side members and a net of relatively limp material, which is attached to the frame and hangs below the table top to form a ball-receiving pocket.

3 Claims, 6 Drawing Figures

FIG. 1.
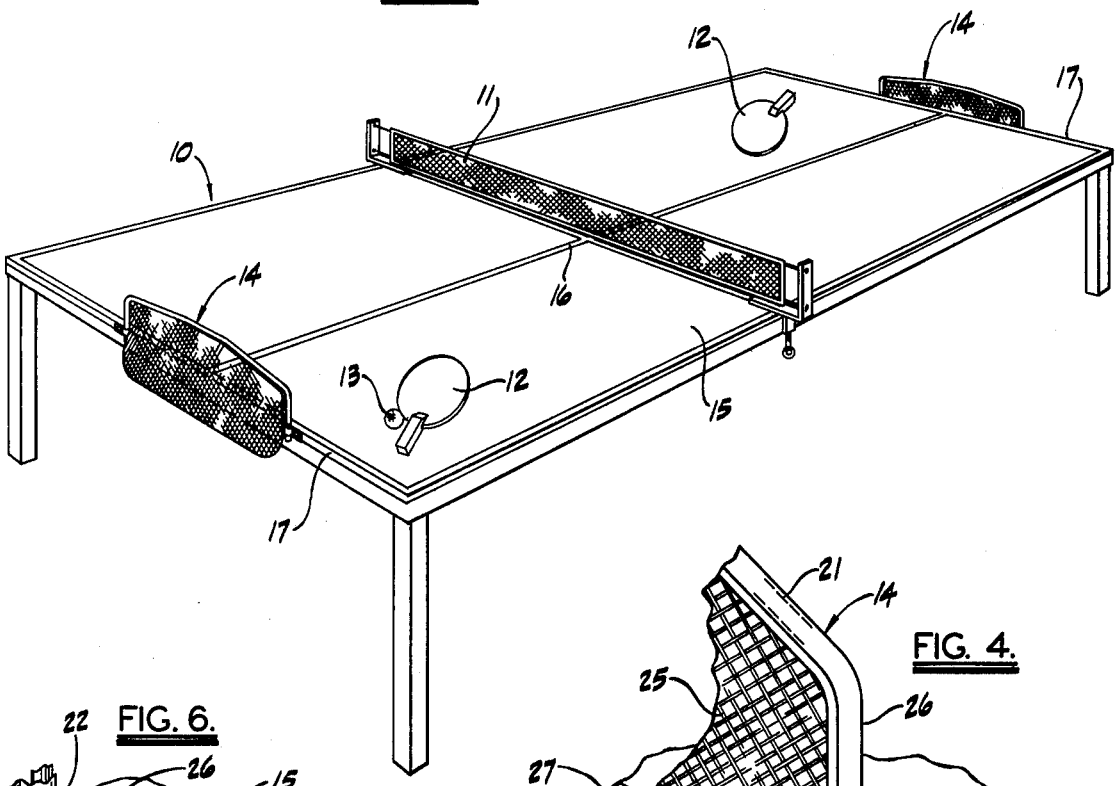
FIG. 4.
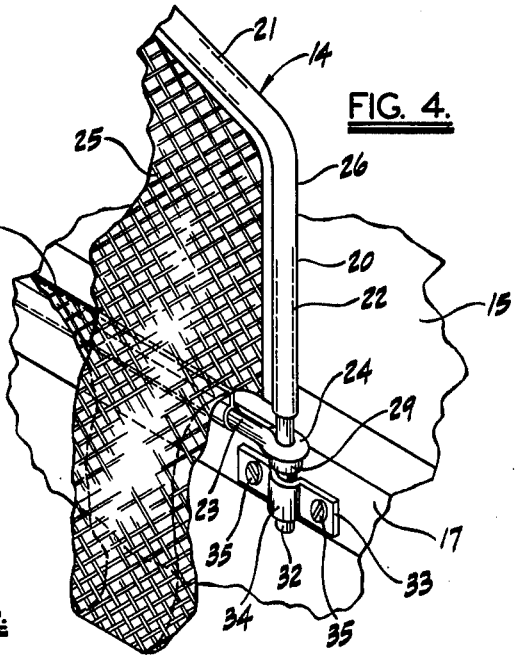
FIG. 6.
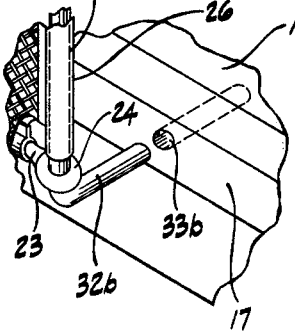
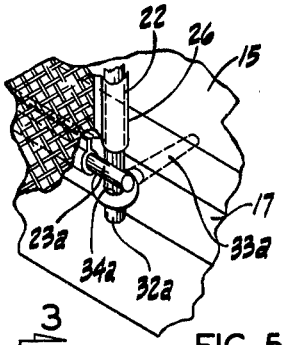
FIG. 5.
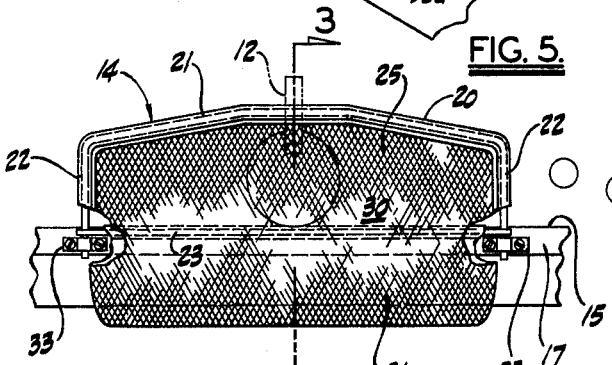
FIG. 2.
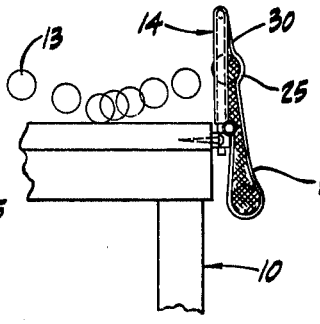
FIG. 3.

TABLE TENNIS TABLE GOAL CONVERSION KIT

BACKGROUND OF THE INVENTION

This invention relates to a table tennis game employing end goals and particularly to a conversion kit by which a conventional table tennis table can be readily adapted to play the game.

The conventional table tennis game is universally popular as is evidenced by the many millions of players in the United States alone. Alternatives to the conventional game have been suggested from time to time in an attempt to provide the players with variety, and in addition, to assist in polishing the skills required in certain aspects of the game. However, known variations have required that the table be irreversibly modified, for example by providing cut-out goal holes in the table top. Practice net devices are also known but, in general, provide a single net mounted at one end of the table and having a return apparatus for the convenience of a single player. Such apparatus tends to be cumbersome and not readily removable from the table for conventional play.

The present game overcomes these deficiencies in a manner not disclosed in the known prior art.

SUMMARY OF THE INVENTION

This table tennis game provides an alternative to the conventional game in the form of a variation which employs end goals.

An important object of this invention is to provide a conversion kit which includes a pair of end goals each formed from a frame having upper, lower and side members and a net attached to the frame in depending relation to the lower member to form a ball-receiving pocket below the table top.

Another important object is to provide end goals which are readily attachable to the table top and immediately removable when resumption of normal play is desired.

It is an object to provide a goal attachment means which does not affect the table top for regular play.

Yet another object is to provide a table tennis conversion kit which is simple to manufacture, and provides end goals which are readily installed for use in conjunction with conventional equipment to play a game which is easily understood.

BRIEF DESCRIPTION OF THE DRAWINGS

FIG. 1 is a perspective view illustrating the game equipment;

FIG. 2 is an enlarged end view of a goal;

FIG. 3 is a cross-sectional view taken on line 3-3 of FIG. 2;

FIG. 4 is an enlarged fragmentary detail illustrating the mounting means for the goal;

FIG. 5 is a similar detail illustrating a modified mounting means; and

FIG. 6 is a similar detail illustrating another modified mounting means.

DESCRIPTION OF THE PREFERRED EMBODIMENT

Referring now by characters of reference to the drawing, and first to FIG. 1, it will be understood that in the preferred embodiment the table 10, center net 11, paddles 12 and ball 13 are those used in conjunction with the conventional table tennis game. In addition to these items a pair of goals, generally indicated by numeral 14, provide the means by which the conventional game is converted into an end goal game. As clearly shown in FIGS. 1 and 2, each goal 14 extends above the table top 15 and is symmetrically disposed relative to the center line 16. And as will appear each goal is attached in removable relation to one of the opposed ends 17 of the table top 15.

As disclosed in FIGS. 2, 3 and 4 each goal 14 includes a frame 20, of wire or plastic, which includes an upper member 21, side members 22 and a lower transverse member 23. The lower transverse member 23 extends between said side members 22 and is attached to said side members as by end loops 24. Each goal 14 is provided with a net, indicated generally by numeral 25, which is attached as by peripheral sleeve elements such as those indicated by numerals 26 and 27 to associated frame members 21, 22 and 23. Importantly, the net 25 is formed from relatively limp material similar to that used for fishnets. The net 25 includes upper and lower portions indicated by numerals 30 and 31. The upper portion 30 extends between the upper and lower members 21 and 23 and is thereby substantially exposed above the table top 15. The lower pouch portion 31 is disposed below said lower member 23 and constitutes a ball-receiving pocket which hangs below the table top 15.

It is important for the goals 14 to be removed rapidly from the table 10 and the goal mounting means by which this is achieved will now be described with reference to FIGS. 4, 5 and 6 which illustrate alternative means of attachment. Essentially, the goals 14 are provided with end portions which are releasably secured to the cooperating means provided at the table top end 17. In the embodiment clearly shown in FIG. 4, the frame side members 22 include downwardly projecting portions 32 which are received within the associated socket portions 34 of a pair of transversely spaced brackets 33. The brackets 33 are attached to the table top end 17 as by wood screws 35, and it will be understood that the bracket socket portions 34 are suitably configurated to hold the corresponding projecting portions 32 in frictional relation. As also shown in FIG. 4, the lower frame member 23 is held in place as by seating the end loops 24 on a frictionally fitted short plastic sleeve 29 provided on each side member 22. Alternatively, the lower member 23 can be positioned by engagement of loops 24 with the table top 15 or, if desired, by engagement of the loops 24 with the bracket 33. In any event, the lower frame member 23 is either substantially at the same level as, or slightly below, the level of the table top 15 so as not to obstruct the entry of the ball 13 into the net 25.

FIGS. 5 and 6 disclose two other means of releasably attaching the goal 14 to the table top end 17. For example, FIG. 5 discloses the use of a pair of spaced screw eyes 33*a* which are screwed into the table end 17. The downwardly projecting portion 32*a* of each side member 22 is received within the eye 34*a* and in this embodiment the transverse member, indicated by numeral 23*a* is welded, or otherwise fixedly attached, to each side member 22 and engages the screw eye 33*a* to limit the extent to which the projecting portion 32*a* is received within said screw eye and thereby position the goal. FIG. 6 illustrates another embodiment, in which the table top ends 17 are provided with a pair of spaced, pre-drilled holes 33*b* constituting socket portions. As shown, the projecting portions 32*b* of said side member 22 are bent inwardly to be received within associated holes 33*b*. The loops 24 of the lower member 23 are engageable with said outstanding projections 32*a* to effectively position the goal 14.

The size of the end goals 14 used in conjunction with a conventional 9 feet 0 inches × 4 feet 6 inches table top are best shown by reference to FIGS. 1 and 2. As shown in FIG. 2 the height of each goal 14 above the table top 15 is substantially equal to the play surface of the paddle 12 shown in phantom outline. The width of the goal 14 between side members 22 is approximately three and one-half times the height. The net pouched portion 31 depends below the table top 15 substantially the same amount as the exposed portion 30 extends above said table top.

It is thought that the structural features of the end goals and the attachment thereof to the table have become fully apparent from the foregoing description of parts but for completeness of disclosure the method of play, which by virtue of the end goals has aspects of a table hockey game as well as a table tennis game, will be briefly described.

It will be understood that the means of attachment of the goals 14 form a permanent part of the table 10 so that said goals can be installed and removed instantly. In the case of the disclosure of FIG. 4 the brackets 33 are permanently attached to the table top end 17 as by the screws 15 or by adhesive means. In the embodiment of FIG. 5 the screw eyes 33*a* are maintained permanently in position while in the embodiment of FIG. 6 the pre-drilled holes 33*b* are likewise a permanent feature. The method of attachment in each case provides absolutely no obstruction to normal play when it is desired to resume the conventional table tennis game.

Following the positioning of the goals at each end of the table 10 by inserting the side frame projecting portions 32 with the associated socket portions provided at the table top end 17, the game for two players is played as follows:

The Play:

1. Server serves to opposing player.
2. Opposing player makes return of ball.
3. Server tries to score goal with his second return of ball.
4. Opposing player tries to block the shot and also tries to score in opponent's goal with his return.
5. Play continues until a goal is scored or the ball is hit off the table or into the center net.
6. The last player to hit the ball, if the ball goes off the table, will be the return player on the next play.
7. After the ball has been returned once to the server it may be hit without first hitting the table.
8. Goals may be scored anytime by a player after his second hit of the ball.

Special rules:

Serving:

1. Service ball must hit both sides of the table with the serve.
2. The serve must be from one corner to the diagonally opposite corner.
3. If the service ball hits the center net or the goal or the wrong side of the center line, play is over and the opposing player serves.
4. If the table is missed by the serve the opposing player is awarded a PENALTY shot.

Return of service:

1. The ball must be returned so as to give the server a good hit.
   A. No slams or spin returns are allowed.
   B. No returns into center net or goal are allowed.
   C. Ball must be returned to the same side of the table from which the server served and must hit on server's side to constitute a good return.
2. Any of the above infractions A, B and C gives the server a penalty shot.

Penalty shot:

1. All penalty shots are taken as soon as they are awarded.
2. The penalized player places his paddle in front of his goal at the goal center with the handle up. He may hold the paddle at the upper end to steady it but may not move it to block a penalty shot.
3. The player shooting the penalty shot attempts to serve the ball into the goal. Ball must hit the table on server's side. It need not hit the table on opposing player's side.
4. After a penalty shot the player taking the shot starts the play over with a regular serve.

Blocking shots:

1. Shots may be blocked with paddle only, anything else such as arm, hand, etc. results in a penalty.
2. Shots may be blocked to within 18 inches in front of own goal.

Scoring:

1. 5 goals wins the game. 2 out of 3 games wins the match.
2. No goals on serve or first return count.
3. The ball must be retained in the goal to count.
4. Pushing on the goal to keep the ball out of the goal is not allowed. Goal is allowed if this happens.
5. Ball hitting center net or player and rebounding into goal counts for opposing player.

Center Net:

If the ball hits the center net in play it may be continued in play or the player on whose side it is may start play over with a serve.

The above rules can be modified to some extent without departing from the basic end goal game.

I claim as my invention:

1. In a table tennis game:

a. a conventional table tennis table, b. a pair of goals, each goal including:

1. a frame having an upper member, opposed side members and a transverse lower member extending between said side members,
2. a net of substantially limp material interconnected between said upper and lower frame members and having a connected length sufficient to provide a single, upper net portion between said members and a double, lower net portion depending below said lower member when said frame is substantially upright, said lower net portion forming a ball-receiving pocket, c. means for removably mounting said goal frames to each end of the table tennis table playing surface so that said ball-receiving pocket hangs below said playing surface of the table.

2. A conversion kit for use on the playing surface of a conventional table tennis table, the kit comprising:

a. a pair of goals, each goal including:

1. a frame having an upper member, opposed side members and a transverse lower member extending between said side members,
2. a net of substantially limp material interconnected between said upper and lower frame members and having a connected length sufficient to provide a single, upper net portion between said members and a double, lower net portion depending below said lower member when said frame is substantially upright, said lower net portion forming a ball-receiving pocket, b. means for removably mounting said goal frames to each end of a table tennis table playing surface so that said ball-receiving pocket hangs below said playing surface of the table, c. the frame side members including end portions extending below said lower transverse member, and d. the mounting means including spaced socket members attachable to said table for receiving said frame end portions.

3. A conversion kit for use on the playing surface of conventional table tennis table, the kit comprising:

a. a pair of goals, each goal including:

1. a frame having an upper member, opposed side members and a transverse lower member extending between said side members, 2. a net of substantially limp material interconnected between said upper and lower frame members and having a connected length sufficient to provide a single, upper net portion between said members and a double, lower net portion depending below said lower member when said frame is substantially upright, said lower net portion forming a ball-receiving pocket, b. means for removably mounting said goal frames to each end of a table tennis table playing surface so that said ball-receiving pocket hangs below said playing surface of the table, c. said frame side members including end portions extending transversely of the plane of the frame for removably attaching said frame to said table, and d. socket elements, said socket elements being provided on said table for receiving said end portions.

* * * * *